US006351247B1

(12) United States Patent
Linstrom et al.

(10) Patent No.: US 6,351,247 B1
(45) Date of Patent: Feb. 26, 2002

(54) LOW COST POLARIZATION TWIST SPACE-FED E-SCAN PLANAR PHASED ARRAY ANTENNA

(75) Inventors: Russell Henry Linstrom, Fullerton; Gordon David Niva, Laguna Niguel; Sam H. Wong, Yorda Linda; Douglas K. Waineo, Placentia, all of CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/511,162

(22) Filed: Feb. 24, 2000

(51) Int. Cl.[7] ..... H01Q 21/26

(52) U.S. Cl. ..... 343/797; 343/700 MS; 343/757; 342/368; 342/372

(58) Field of Search ..... 343/700 MS, 757, 343/793, 795, 770, 772, 776, 797; 342/368, 372, 375

(56) References Cited

U.S. PATENT DOCUMENTS

| | | | | | |
|---|---|---|---|---|---|
| 3,611,381 A | | 10/1971 | Preikschat et al. | ..... | 343/100 |
| 4,939,527 A | * | 7/1990 | Lambery et al. | ..... | 343/771 |
| 4,994,813 A | | 2/1991 | Shiramatsu et al. | ..... | 342/360 |
| 5,136,304 A | | 8/1992 | Peters | ..... | 343/777 |
| 5,311,190 A | | 5/1994 | Devendorf et al. | ..... | 342/157 |
| 5,481,268 A | | 1/1996 | Higgins | ..... | 342/70 |
| 5,488,380 A | * | 1/1996 | Harvey et al. | ..... | 342/368 |
| 5,504,493 A | | 4/1996 | Hirschfield | ..... | 342/372 |
| 5,512,906 A | * | 4/1996 | Speciale | ..... | 342/375 |
| 5,537,242 A | | 7/1996 | Lim | ..... | 359/287 |
| 5,745,076 A | | 4/1998 | Turlington et al. | ..... | 342/372 |
| 5,764,187 A | | 6/1998 | Rudish et al. | ..... | 342/372 |
| 6,061,026 A | * | 5/2000 | Ochi et al. | ..... | 343/700 MS |
| 6,184,827 B1 | * | 2/2001 | Dendy et al. | ..... | 342/372 |

* cited by examiner

*Primary Examiner*—Don Wong
*Assistant Examiner*—Shih-Chao Chen
(74) *Attorney, Agent, or Firm*—Harness Dickey & Pierce P.L.C.

(57) ABSTRACT

A polarization twist, space-fed, E-scan planar phased array antenna. The phased array antenna incorporates a polarization twist, space-fed architecture. A plurality of unit cells are formed wherein each cell incorporates a large plurality of phased array elements and associated phase shifters. The space-feed architecture enables 2-bit phase shifters to be employed while still producing low antenna sidelobes. The phased array elements, phase shifters, and associated control circuits for controlling the phase shifters are all preferably formed on one surface of a MMIC substrate. This further simplifies significantly the cost and complexity of manufacturing and testing the E-scan phased array antenna. The antenna can therefore be used in applications where an E-scan phased array antenna would have been too costly to employ. The antenna of the present invention is expected to find particular utility in various radar systems, and more particularly missile defense radar systems where E-scan antennas have traditionally been too expensive to employ.

21 Claims, 6 Drawing Sheets

LOW COST POLARIZATION TWIST SPACE-FED E-SCAN PLANAR PHASED ARRAY ANTENNA

TECHNICAL FIELD

This invention relates to antenna systems, and more particularly to a space-fed, polarization twist, E-scan phased array antenna incorporating ortho-linear phased array elements and micro-electro-mechanical-switch (MEMS) phase shifters that can be provided a monolithic microwave integrated circuit (MMIC) wafer.

BACKGROUND OF THE INVENTION

Missile defense radar systems that require high scan rates would ideally incorporate electronically scanned ("E-scan") antennas rather than mechanically scanned antennas. However, most of past and presently implemented radar systems have incorporated mechanically scanned antennas instead of E-scan phased array antennas. The major reason for this is the development and production cost of past and present E-scan phased array antennas, which are significantly more costly to manufacture than mechanically scanned antennas. Another reason is that past and presently implemented E-scan phased array antennas are less efficient than mechanically scanned antennas because conventional E-scan phase shifters have high insertion loss, especially at millimeter wave frequencies. Conventional corporate-fed E-scan phased arrays also require complex feed networks, as well as having high insertion losses, especially for a large millimeter wave, E-scan phased arrays. These conventional corporate-fed E-scan phased array antennas also require a large number of phase shifter bits to produce low phase quantization sidelobes.

Conventional space-fed E-scan phased array antennas also have significant drawbacks. The space-fed E-scan phased arrays occupy a large volume in back of the array aperture that reduces valuable space required for other electronics.

Conventional E-scan reflector phased arrays have a large aperture blockage caused by the feed and sub-reflector, which produces undesired high antenna pattern sidelobes. In addition, the radiating elements of such arrays are structurally complex, and each element module consists of numerous independent parts requiring multilayered and multi-connection circuit construction. At the millimeter wave frequency, the fabrication tolerance requirements of individual parts is extremely exacting, which also significantly increases the fabrication cost of such arrays.

It is therefore a principal object of the present invention to provide a low cost, E-scan phased array antenna which provides improved performance at significantly reduced manufacturing costs to thereby enable its use in broad applications involving radar systems.

It is still another object of the present invention to provide a low cost, E-scan phased array antenna which does not require a complex feed network having high insertion losses, and which therefore is particularly well suited for large millimeter wave E-scan phased arrays.

It is still another object of the present invention to provide a low cost E-scan phased array antenna which requires fewer phase shifter bits for each array element to produce low antenna sidelobes.

SUMMARY OF THE INVENTION

The above and other objects are met by a polarization twist, planar, space-fed E-scan phased array antenna in accordance with preferred embodiments of the present invention. The antenna comprises a polarization twist Cassegrain space-feed architecture and a plurality of ortho-linear polarization array elements and electronic phase shifters. In one preferred embodiment, the electronic phase shifters comprise micro-electro-mechanical-switches (MEMS) phase shifters. In various preferred embodiments, the phased array elements comprise ortho-linear polarization elements, microstrip patches, dipoles, or slots, but are not limited to these embodiments. The specific types of ortho-linear polarization phased array elements, the relative placement of phased array elements and phase shifters may all vary to meet specific design criteria.

Each phased array element is formed on a monolithic microwave integrated circuit (MMIC) substrate. The simplified construction and electrical connections provided by the phased array elements permit several thousand phased array elements to be formed on one or more layers of the MMIC substrate. The antenna of the present invention reduces the number of phase shifter bits on each phased array element to enable all, or substantially all, of the necessary components of each phased array element (i.e., radiating element, phased shifters and control circuits) to be fit into a planar unit cell area. This makes the antenna of the present invention significantly more structurally simple than previously developed E-scan phased array antennas. With fewer phase shifter bits per array element, processing yields can be significantly increased, thus enabling the production of E-scan, phased array antennas to be employed in missile defense radar systems and other applications where the E-scan phased array antenna would have been too costly to employ.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
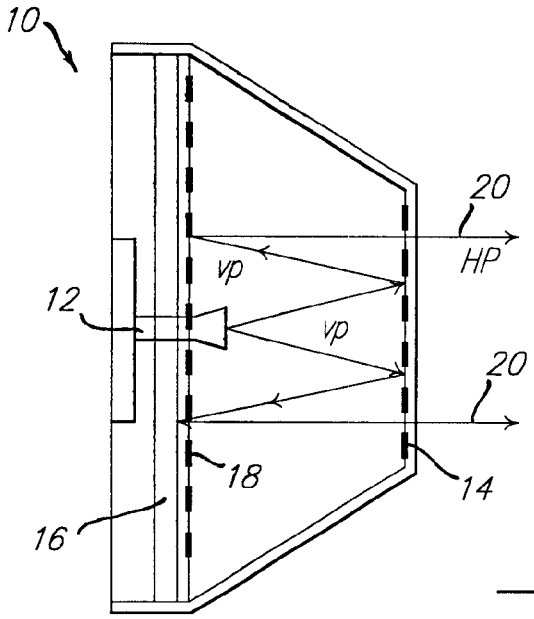
FIG. 1 is a top simplified cross sectional view of a polarization twist space-fed E-scan phased array antenna in accordance with a preferred embodiment of the present invention.

Referring to FIG. 1, there is shown a polarization twist, space-fed E-scan phased array antenna 10 in accordance with a preferred embodiment of the present invention. The antenna 10 generally comprises a monopulse feedhorn 12, a dichroic sub-reflector 14, and a primary radiating member 16 having a plurality of space-fed, ortho-linear polarization twist phased array elements 18. The dichroic subreflector 14, in one preferred form, comprises resident dipoles or wire grids.

In transmit operation, millimeter wave (MMW) energy is transmitted through the feedhorn 12 and impinges the sub-reflector 14. Vertically polarized energy is reflected by the sub-reflector 14 onto the phased array radiating elements 18. The phased array elements 18 receive the vertically polarized MMW energy and provide the necessary phase shifting and rotation to generate horizontally polarized MMW energy, as indicated by arrows 20. The horizontally polarized MMW energy is able to pass through the sub-reflector 14 without obstruction. In addition to the advantages provided by the simplified construction of the phased array radiating elements 18, as will be discussed further, the antenna 10 forms a "folded" design thus enabling the antenna 10 to be more compact than previously developed MMW antennas.

Figure 2:
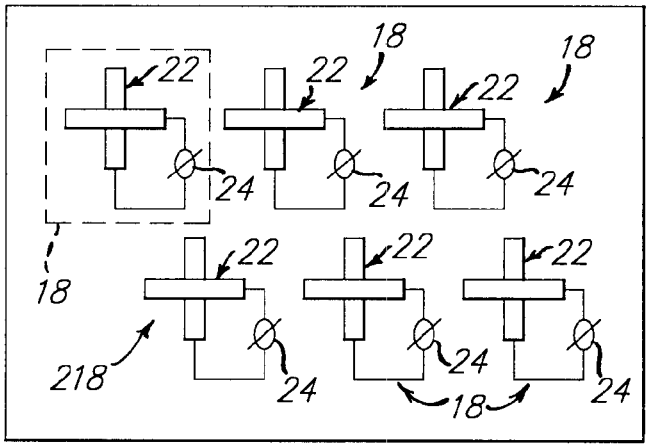
FIG. 2 is a simplified schematic representation of the phased array elements of the antenna of FIG. 1, wherein the phased array elements in FIG. 2 comprise ortho-linear polarization dipole phased array elements.

Referring to FIG. 2, one preferred form of the ortho-linear polarization phased array radiating devices 18 is shown. In this embodiment, each ortho-linear phased array device includes an ortho-linear polarization dipole phased array element 22 and a phase shifter 24. Virtually any suitable phase shifter could be used, but in one preferred form the phase shifter 24 comprises a 2-bit micro-electro-mechanical-switch (MEMS) for performing the needed phase shifting. Other preferred forms of phase shifters could comprise 3-bit or higher level phase shifters if needed by a specific application. It will also be appreciated that by the term "ortho-linear", it is meant a phased array element having a receiving element and a transmitting element orientated perpendicularly to the receiving element.

The polarization twist space-fed E-scan phased array architecture uses a polarization twist Cassegrain space-feed architecture. The polarization twist Cassegrain space-feed architecture provides a number of benefits over other available architectures. For one, it is less complex and has lower insertion losses, as compared to a corporate-fed architecture, especially at MMW frequencies. It also occupies a smaller volume in back of the array aperture compared to a conventional space-fed architecture that has a feed behind the radiating aperture. Compared to a conventional Cassegrain space-fed architecture, it removes the large aperture blockage by the sub-reflector that produces undesirable high antenna pattern sidelobes. At the present time it is believed that the polarization twist Cassegrain space-feed architecture is the best compromise antenna architecture for E-scan phased arrays in terms of RF performance, thermal dissipation, structural complexity, structural rigidity and volume requirements.

Figure 3:
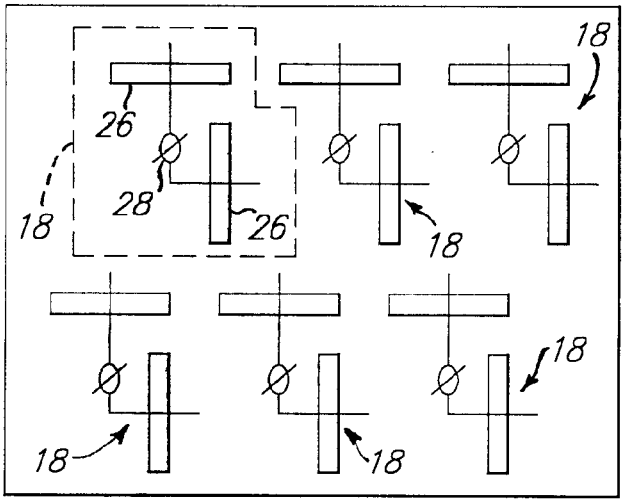
FIG. 3 is a simplified schematic view of the phased array elements shown in FIG. 1, wherein the phased array elements instead comprise a plurality of ortho-linear polarization slot phased array elements.

Referring to FIG. 3, an alternative form of the polarization twist phased array radiating devices 18 is shown in which ortho-linear polarization slot phased array elements 26 are incorporated together with phase shifters 28. The specific form of ortho-linear polarization phased array element used is strictly a matter of design choice. The embodiments illustrated in FIGS. 6 through 13 show additional embodiments of this component. Other appropriate alternative forms of the phased array devices will also be apparent to those of ordinary skill in the art.

Figure 4:
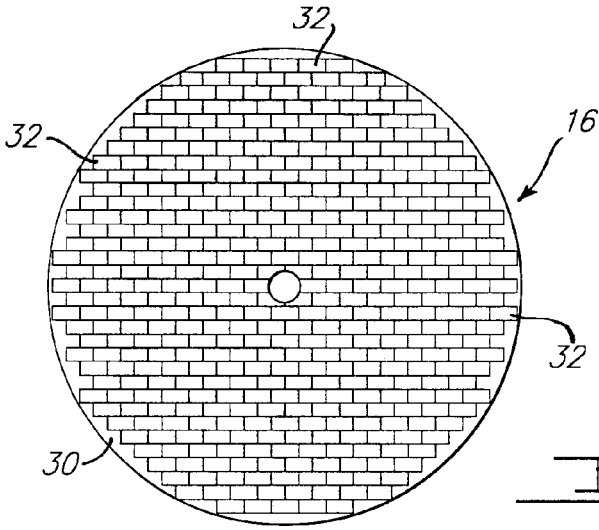
FIG. 4 is a simplified illustration of the large plurality of unit cells, each of which includes the polarization twist phased array elements and phase shifters illustrated in FIGS. 2 and 3.
Figure 5:
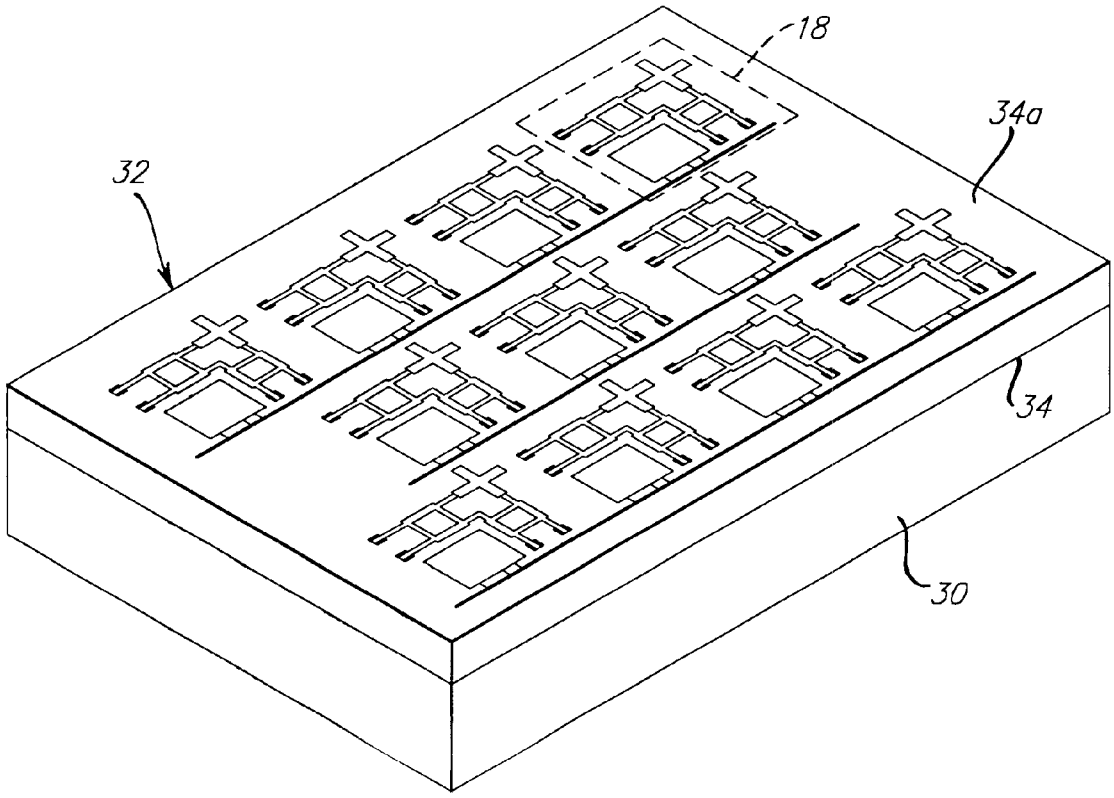
FIG. 5 is a simplified perspective view of one of the unit cells illustrated in FIG. 4.

Referring now to FIG. 4, the primary radiating member 16 can be seen to be comprised of a structural support member 30. The structural support member 30 supports a large plurality of unit cells 32, with each unit cell 32 including a large plurality of the polarization twist phased array radiating devices 18 illustrated either in FIGS. 2 or 3. FIG. 5 illustrates one unit cell 32, with the polarization twist phased array radiating devices 18 being shown in highly enlarged fashion. It is preferred that the phased array radiating devices 18 be formed on one surface of a monolithic microwave integrated circuit (MMIC) substrate 34. The MMIC substrate 34 is disposed on a portion of the structural support member 30 closely adjacent other unit cells 32 such that the unit cells 32 correctively form a generally disc-like radiating member.

It will be appreciated that the polarization twist space-fed E-scan phased array antenna 10 of the present invention is significantly less costly and complex to produce as compared with corporate fed E-scan phased array antennas. The use of a space feed reduces the number of phase shifter bits that are required to produce low antenna pattern sidelobes. The structural and manufacturing complexity, as well as the overall cost, of the antenna is also reduced correspondingly because of the ability to use 2-bit phase shifters rather than 3-bit or 4-bit phase shifters to produce the required low antenna pattern sidelobes.

In practice, each unit cell 32 preferably incorporates a very large plurality, typically on the order of about 5000 or more, of polarization twist phased array radiating devices 18 formed on a surface 34*a* of the MMIC substrate 34 of each unit cell 32. Such phased array device density would not be possible with a corporate feed architecture requiring phase shifters having several bits of phase shifting capability and the complicated control circuits associated therewith. Thus, the ability to use 2-bit phase shifters while maintaining low antenna sidelobes is a principal advantage of the present invention and significantly reduces the cost and complexity of manufacturing and testing the antenna 10.

Figure 6:
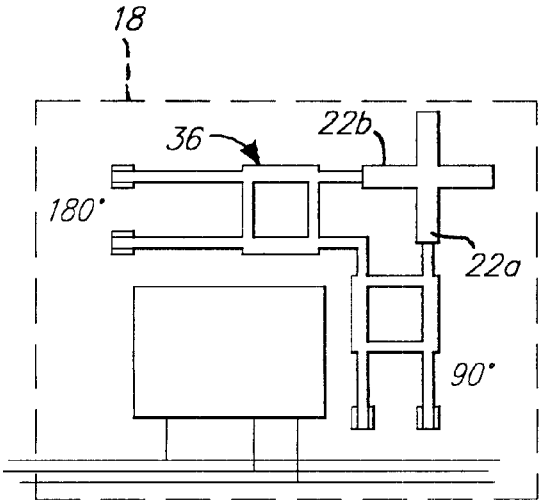
FIG. 6 is a highly enlarged, simplified schematic representation of the phased array element and a 2-bit MEMS phase shifter, in accordance with one preferred form of the present invention.
Figure 7:
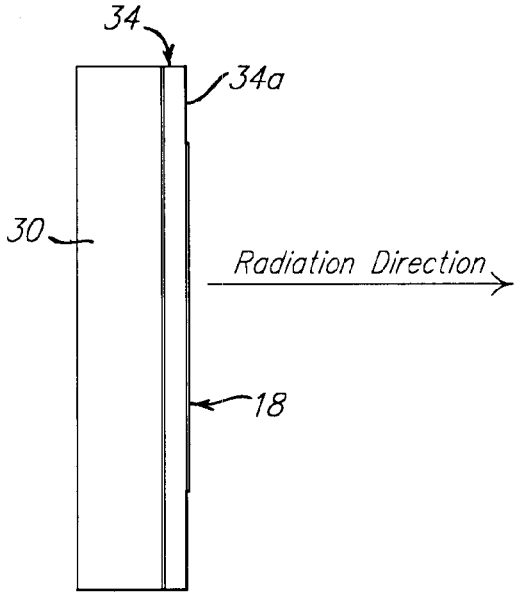
FIG. 7 is a side view of the unit cell of FIG. 5 illustrating the orientation of the phased array element and phase shifter shown in FIG. 6 on the MMIC substrate.

Referring now to FIG. 6, a highly enlarged view of one phased array radiating device 18 is illustrated. In this embodiment the phased array device 18 comprises the polarization twist cross dipole E-scan phased array element 22, with legs 22*a* and 22*b* thereof coupled to a 2-bit MEMS phase shifter 36. The 2-bit MEMS phase shifter 36 is capable of providing zero degree phase shift, 90 degree phase shift, 180 degree phase shift and 270 degree phase shift. A control circuit 38 is employed for controlling the MEMS phase shifter 36 to employ the needed phase shift. Referring to FIG. 7, it can be seen that the ortho-linear polarization cross dipole 22, the phase shifter 36 and the control circuit 38 are all located on one surface 34*a* of the MMIC substrate 34. Control circuits may be located on another layer for closely spaced array elements.

Figure 8:
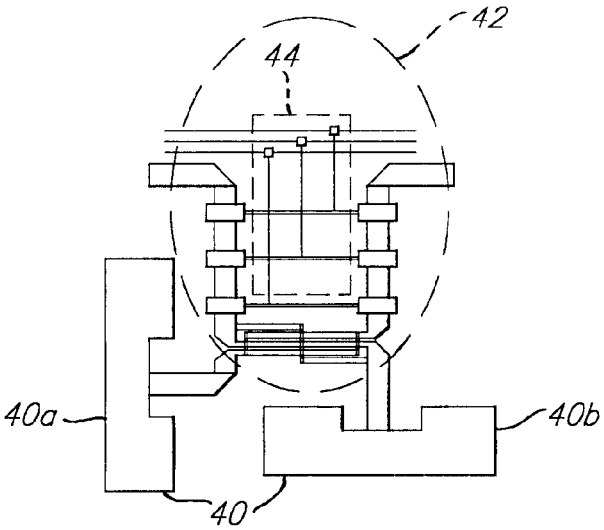
FIG. 8 is a simplified schematic view of an alternative embodiment of the ortho-linear polarization phased array element incorporating a 2-bit MEMS phase shifter with a Lange coupler
Figure 9:
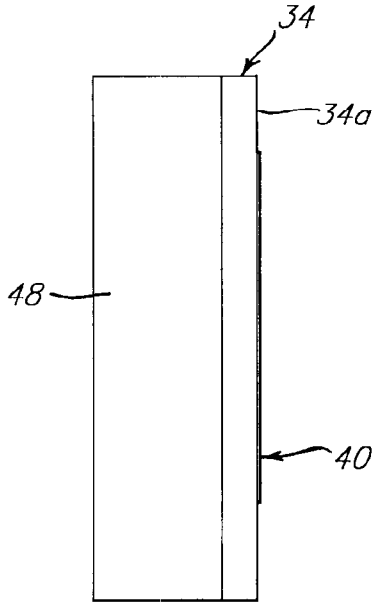
FIG. 9 is a side view of a unit cell similar to that shown in FIG. 5 but including the components shown in FIG. 8.

Referring to FIGS. 8 and 9, yet another alternative preferred form of the space-fed polarization twist E-scan phased array radiating device 18 is shown. This embodiment is denoted by reference numeral 18". The phased array device 18" comprises a microstrip patch phased array element 40 having two elements 40*a* and 40*b* thereof coupled to a 2-bit phase shifter with a 3*db* Lange coupler, denoted by reference numeral 42. The 2-bit phase shifter 42 is controlled by control circuit lines 44 which are electrically coupled to the phase shifter 42.

Referring to FIG. 9, the microstrip patch phased array element 40 resides on the surface 34*a* of the MMIC substrate 34 over a mechanical support structure 48. The phase shifter 42 and control circuit lines 44 are represented in highly simplified form in FIG. 9. Again, with this embodiment the phased array element 40, the phase shifter 42 and the control circuit lines 44 are all formed on the same surface of the MMIC substrate 34.

Figure 10:
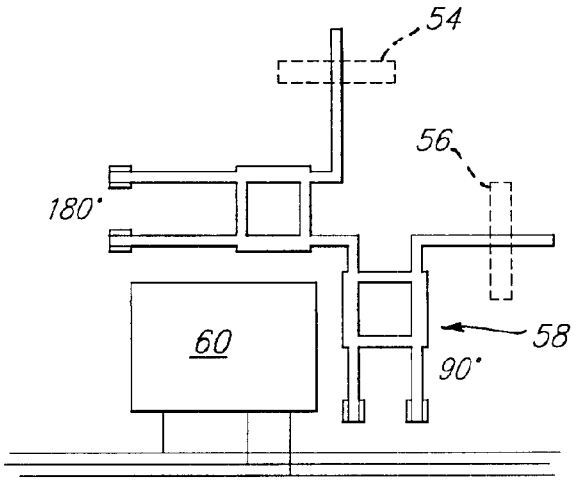
FIG. 10 is yet another alternative preferred form of the polarization twist space-fed phased array component illustrating the use of microstrip slots for performing the vertical and horizontal polarizations, in addition to a 2-bit MEMS phase shifter for performing the phase shifting function.
Figure 11:
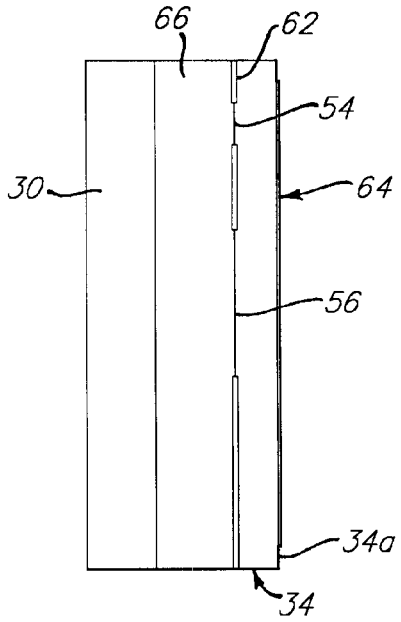
FIG. 11 is a side view of a unit cell similar to that shown in FIG. 5 but incorporating the components of FIG. 10.

Referring to FIGS. 10 and 11, yet another alternative preferred embodiment of the polarization twist E-scan phased array radiating device 18 is illustrated. Referring specifically to FIG. 10, in this embodiment the phased array device is comprised of a first microstrip slot 54 for providing vertical polarization of the MMW signal and a second microstrip slot 56 for providing horizontal polarization of the MMW signal. A 2-bit phase shifter 58 is employed together with a control circuit 60 for controlling the phase shifter 58. In FIG. 11, it can be seen that the microstrip slots 54 and 56 are formed by slot-like openings in a member or plate 62 which impedes the passage of MMW energy therethrough, except through the microstrip slots 54 and 56. The phase shifter 58 and control circuit 60 are both disposed on surface 34*a* of the MMIC substrate 34 and indicted in highly simplified form by layer 64 formed on surface 34*a* of the MMIC substrate 34. This embodiment further includes a dielectric spacer 66 which separates the MMIC substrate 34 from the structural support member 30.

Figure 12:
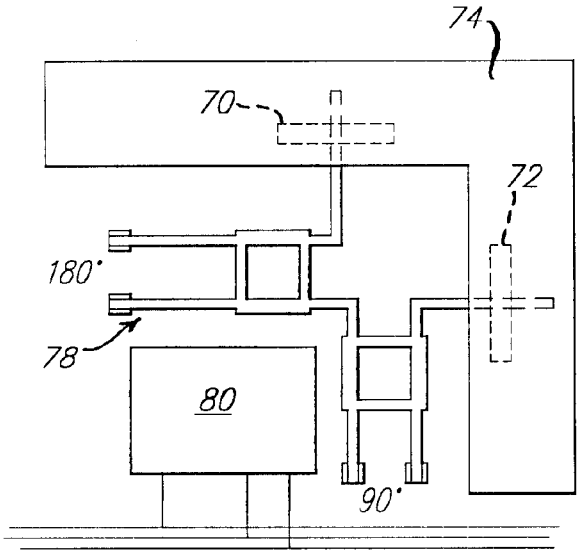
FIG. 12 is another alternative preferred embodiment of the polarization twist phased array device incorporating a stripline cavity backed vertical polarization slot and a stripline cavity backed horizontal polarization slot, together with a 2-bit MEMS phase shifter.
Figure 13:
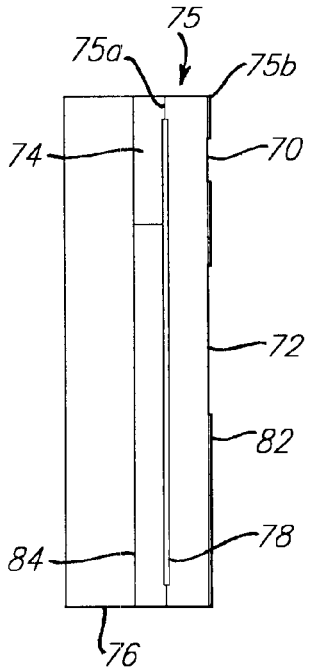
FIG. 13 is a side view of a unit cell, such as that shown in FIG. 5, except incorporating the components shown in FIG. 12.

Referring to FIGS. 12 and 13, yet another embodiment of the polarization twist, E-scan phased array radiating device 18 is illustrated. In this embodiment a first microstrip slot 70 for providing vertical polarization of the MMW energy and a second microstrip vertical polarization slot 72 for providing horizontal polarization of the MMW signal are disposed over a dielectric filled cavity 74 formed in a support structure 76 (FIG. 13). A 2-bit MEMS phase shifter 78 is employed, and a control circuit 80 for controlling the phase shifter 78 is also incorporated. FIG. 13 illustrates that the phase shifter 78 and the control circuit 80 are located on a rear surface 75*a* of a MMIC substrate 75, while the vertical and horizontal microstrip polarization slots 70 and 72, respectively, are formed in a thin planar member 82, such as a metal plate, disposed on a front surface 75*b* of the MMIC substrate 75. The support structure 76 is used to support a dielectric spacer 84 and the MMIC substrate 75 thereon.

Accordingly, it will be appreciated that the phased array radiating devices illustrated and described herein each comprise various forms of phased array radiating devices which may be employed in the polarization twist, space-fed, E-scan phased array antenna of the present invention. While 2-bit phase shifters have been illustrated in these figures, it will be appreciated that 3-bit or higher order phase shifters may be employed, but that such will obviously increase the manufacturing complexity and cost of the antenna, as well as limit the density of phased arrays that can be accommodated on any given size substrate.

Figure 14:
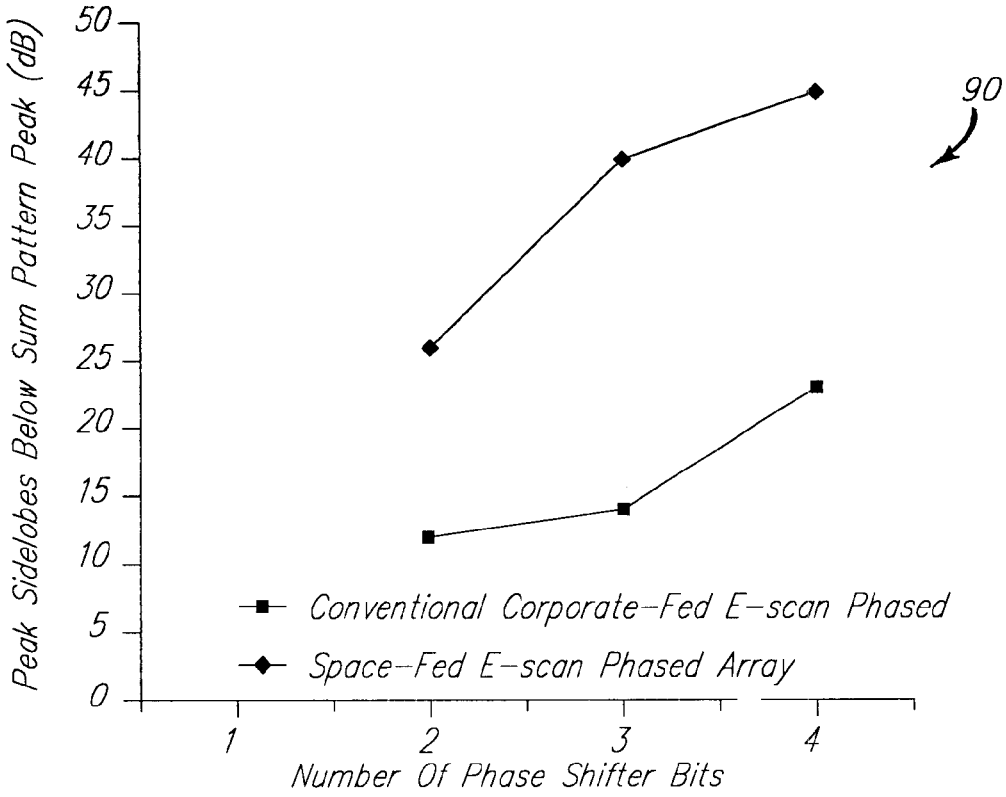
FIG. 14 is a graph illustrating the phase quantization peak sidelobe comparison of a polarization twist space-fed E-scan phased array antenna in accordance with the preferred embodiments of the present invention relative to conventional corporate fed E-scan phased array antennas.

Referring to FIG. 14, graph 90 indicates a phase quantization peak sidelobe comparison for a space-fed E-scan phased array antenna in accordance with the present invention and a corporate fed E-scan phased array antenna. Graph 90 illustrates the increased number of sidelobes of the signal produced by the antenna of the present invention which are below the predetermined signal level, for an antenna employing 1, 2, 3 and 4 bit phase shifters.

Figure 15:
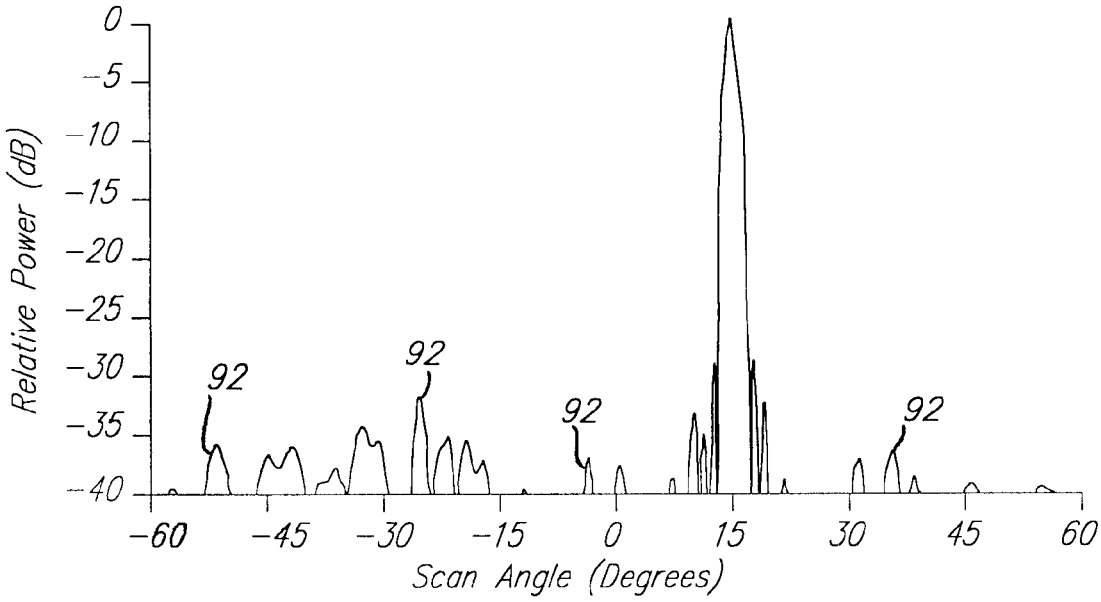
FIG. 15 is an antenna pattern comparison graph illustrating the sidelobes of a signal transmitted by the antenna at a theta scan angle of 15 degrees.
Figure 16:
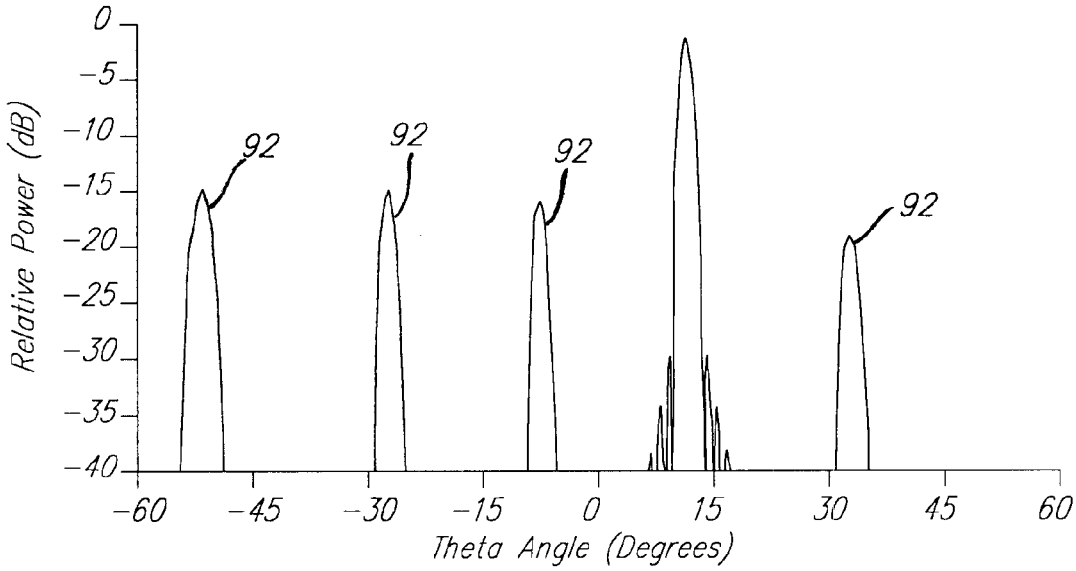
FIG. 16 is a graph of the same signal transmitted by a conventional corporate-fed phased array antenna as FIG. 15, illustrating the significant increase in phase quantization sidelobes.

FIG. 15 is an illustration of a signal transmitted by the polarization twist, space-fed, E-scan phased array antenna of the present invention at a theta scan angle of 15 degrees, while FIG. 16 illustrates the same signal generated by a conventional corporate fed phased array antenna. It will be noted that the magnitude of the sidelobes 92 shown in FIG. 16 has been reduced significantly in the graph of FIG. 15.

The polarization twist, space-fed, E-scan, planar phased array antenna of the present invention thus takes advantage of the polarization twist space feed architecture, along with a very large plurality of phased array radiating elements required for a small diameter antenna at millimeter wave frequencies. These features of the present invention produce an E-scan phased array antenna which produces low antenna sidelobes with a minimum number of phase shifter bits on each phased array element. This enables most, if not all, of the necessary components of each phased array radiating element (i.e., radiating element, phase shifters and control circuits) to be packaged into a planar unit cell area. This feature makes the antenna of the present invention much more structurally simple to construct and test than previously developed space-fed E-scan phased array antennas, and therefore less costly than previously developed space-fed E-scan phased array antennas. Also, because the number of phase shifter bits required by the antenna of the present invention is less than previously developed phased array E-scan antennas, the processing yield of each array element with MEMS shifters is also increased.

The design architecture of the present invention thus allows very large numbers of phased array elements, phase shifters and associated control circuits to be accommodated on a single MMIC waiver in a much more cost efficient implementation. These improvements enable the antenna of the present invention to be used on many forms of radar systems, and particularly on missile defense systems, where E-scan phased array antennas have heretofore been too costly to employ.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A polarized twist, space-fed, electronically scanned, planar phased array antenna comprising:

a substrate;

a plurality of space-fed, electronically scanned phased array radiating elements disposed on said substrate for receiving and transmitting radio frequency signals, each said phased array radiating element comprising a plurality of ortho-linear polarization phased array elements and a plurality of phase shifting elements, each one of said phase shifting elements being independently associated with one of said ortho-linear polarization phased array elements; and a control circuit for controlling said phase shifting elements to produce a desired phase shift in said radio frequency signals transmitted by said antenna to thereby enable steering of a radio frequency signal transmitted by said ortho-linear polarization phased array elements.

2. The polarization twist, space-fed, electronically scanned antenna of claim 1, wherein the phase shifting elements each comprise a micro-electro-mechanical switch (MEMS) element.

3. The polarization twist, space-fed, electronically scanned, planar phased array antenna of claim 2, wherein said plurality of ortho-linear polarization array elements, said MEMS elements and said control circuit are formed on a monolithic microwave integrated circuit (MMIC) which forms said substrate.

4. The polarization twist, space-fed, electronically scanned, planar phased array antenna of claim 1, wherein said ortho-linear polarization phased array elements each comprise an ortho-linear polarization phased array dipole radiating element.

5. The polarization twist, space-fed, electronically scanned, planar phased array antenna of claim 1, wherein said ortho-linear polarization phased array element comprises a ortho-linear polarization slot phased array element.

6. The polarization twist, space-fed, electronically scanned, planar phased array antenna of claim 2, wherein said MEMS element comprises a two bit or higher order MEMS phase shifter.

7. The polarization twist, space-fed, electronically scanned, planar phased array antenna of claim 1, wherein each said phase shifting element comprises a two bit or higher order phase shifter.

8. The polarization twist, space-fed, electronically scanned, planar phased array antenna of claim 1, further comprising a structural support plate having a cavity; and wherein said ortho-linear polarization array element comprises a cavity backed microstrip cross dipole element disposed over said cavity.

9. The polarization twist, space-fed, electronically scanned, planar phased array antenna of claim 8, wherein said cavity is filled with a dielectric material.

10. The polarization twist, space-fed, electronically scanned, planar phased array antenna of claim 1, wherein each said phased array radiating element comprises a vertically polarized microstrip slot and a horizontally polarized microstrip slot, each of said slots being formed in said substrate.

11. A polarization twist, space-fed, electronically scanned, planar phased array antenna comprising:

at least one monolithic microwave integrated circuit (MMIC);

a structural support element for supporting said MMIC;

a plurality of space-fed, electronically scanned phased array radiating elements formed on said MMIC for receiving and transmitting radio frequency signals, each said phased array radiating element comprising:

at least one ortho-linear polarization phased array element;

at least one phase shifting element electrically coupled to each said ortho-linear polarization phased array element for producing a desired degree of phase shift in said radio frequency signal transmitted by said antenna; and a control circuit for controlling each said phase shifting element to produce said desired degree of phase shift.

12. The polarization twist, space-fed, electronically scanned, planar phased array antenna of claim 11, wherein said phase shifting element comprises a micro-electro-mechanical-switch (MEMS) phase shifting element.

13. The polarization twist, space-fed, electronically scanned, planar phased array antenna of claim 12, wherein said plurality of ortho-linear polarization phased array elements, said MEMS phase shifting elements and said control circuit are formed on one surface of said MMIC.

14. The polarization twist, space-fed, electronically scanned, planar phased array antenna of claim 13, wherein each said MEMS phase shifting element comprises a 2-bit MEMS phase shifter.

15. The polarization twist, space-fed, electronically scanned, planar phased array antenna of claim 11, wherein said phase shifting element comprises a phase shifter operable to provide at least three stages of phase shift to a radio frequency signal transmitted by said antenna.

16. The polarization twist, space-fed, electronically scanned planar phased array antenna of claim 11, wherein said structural support element comprises a cavity;

wherein said cavity includes a dielectric element; and wherein one of said ortho-linear polarization phased array elements is disposed over said cavity.

17. The polarization twist, space-fed, electronically scanned, planar phased array antenna of claim 11, wherein said ortho-linear polarization phased array elements each comprise microstrip cross dipoles formed in said MMIC.

18. A method for forming a polarization twist, space-fed, electronically scanned, planar phased array antenna, said method comprising the steps of:

providing a structural support member;

forming a monolithic, microwave integrated circuit (MMIC) including a plurality of electronically scanned phased array radiating elements thereon for receiving and transmitting radio frequency signals, and placing said MMIC on said structural support member; and forming each said phased array radiating element to include an ortho-linear polarization phased array element, at least one phase shifting element for providing a desired degree of phase shifting to said radio frequency signals transmitted by said antenna, and a control circuit for controlling said phase shifting elements to provide said desired degree of phase shifting.

19. The method of claim 18, wherein the step of forming each said phased array radiating element to include an ortho-linear polarization phased array element comprises the step of forming said radiating elements to comprise ortho-linear polarization dipole phased array elements.

20. The method of claim 18, wherein the step of forming each said phased array radiating element to include an ortho-linear polarization phased array element comprises the step of forming said radiating elements to comprise ortho-linear polarization slot phased array elements.

21. The method of claim 18, wherein the step of forming each said phased array radiating element to include phase shifting elements includes forming a micro-electro-mechanical-switch (MEMS) phase shifting element for providing two or more levels of phase shift to said radio frequency signal.

* * * * *